United States Patent [19]

Selway

[11] 4,166,932

[45] Sep. 4, 1979

[54] OPTICAL MICROPHONE WITH RECTANGULAR FIBER OPTICS

[75] Inventor: Peter R. Selway, Sawbridgeworth, England

[73] Assignee: International Standard Electric Corporation, New York, N.Y.

[21] Appl. No.: 936,958

[22] Filed: Aug. 25, 1978

[30] Foreign Application Priority Data

Sep. 7, 1977 [GB] United Kingdom.....37287/77

[51] Int. Cl.[2] ..... H04R 23/00

[52] U.S. Cl. ..... 179/121 R

[58] Field of Search ..... 179/121 R, 138, 100.41 L

[56] References Cited

U.S. PATENT DOCUMENTS 3,818,369 6/1974 Brocker ..... 179/138

*Primary Examiner*—George G. Stellar

*Attorney, Agent, or Firm*—John T. O'Halloran; Jeffrey P. Morris

[57] ABSTRACT

An acousto-optic transducer which may be employed in a telephone subscriber instrument is described in which movement of a diaphragm varies the degree of coupling between the ends of two rectangular optical fibers having rectangular cross sections and which are coupled to the diaphragm for linearly amplitude modulating light signals passing between the fiber ends.

6 Claims, 2 Drawing Figures

OPTICAL MICROPHONE WITH RECTANGULAR FIBER OPTICS

BACKGROUND OF THE INVENTION

1. Field of the Invention

This invention relates to opto-acoustic transducers and in particular to an arrangement for converting speech signals into amplitude modulated optical signals.

2. Description of the Prior Art

One of the problems encountered with optical, i.e. optical fiber, telephone transmission systems, is the provision of an interfacing device between a conventional electric or electronic telephone subset. In present systems this interfacing device comprises a light source the output of which is modulated by an electrical signal derived from the information to be transmitted. A fiber optic switch is described by N. H. Leighton, Fiber Optic Shutter, IBM Technical Disclosure Bulletin, Vol. II, No. 18, January 1969, pp. 912–913. U.S. Pat. No. 2,835,744 describes the modulation of a light beam in response to sound signals in a microphone.

SUMMARY OF THE INVENTION

According to the present invention there is provided an acousto-optic transducer arrangement, (a microphone) including a housing, a flexible diaphragm supported on the housing, a first rectangular optical fiber, one end of which is coupled to the diaphragm, and a second rectangular optical fiber, one end of which is secured to the housing such that the one ends of the fibers are so positioned as to provide optical coupling therebetween, and in which movement of the diaphragm causes corresponding variations in the degree of coupling between the fiber ends thus modulating light signals passing between the fiber ends and providing linear amplitude modulation.

An embodiment of the invention will be described with reference to the accompanying drawing wherein:

DESCRIPTION OF THE PREFERRED EMBODIMENT

Figure 1:
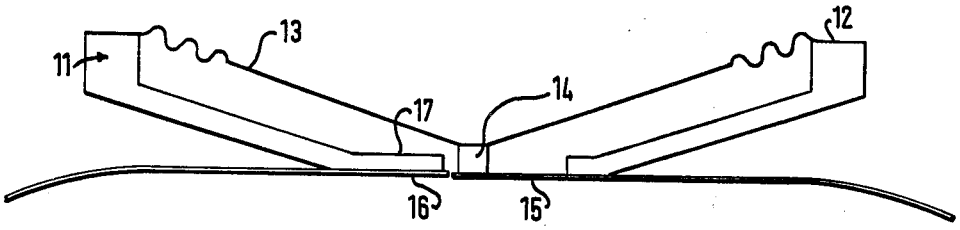
FIG. 1 is a cross-sectional view of an opto-acoustic transducer in accordance with the invention.
Figure 2:
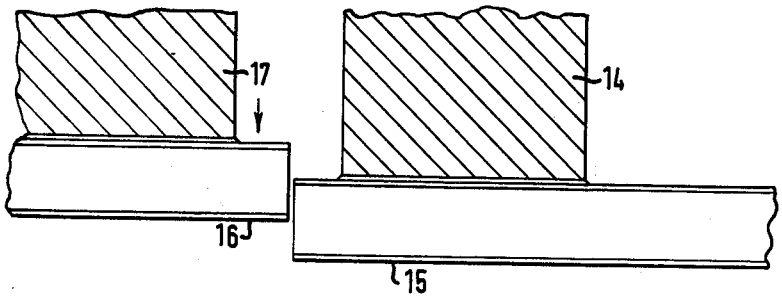
FIG. 2 shows in detail the fiber optic coupling region of the transducer of FIG. 1.

Referring to the drawing, the transducer assembly, which is intended for use as a microphone and may, for example, be fitted to a telephone subscriber's instrument, includes a rigid plastics frusto-conical housing 11 the larger end of which is provided with a rim portion 12 on which a diaphragm 13 is supported. The center portion of the diaphragm 13 supports a plastics block 14 to which the end of a first optical fiber 15 is secured. Note that for clarity the microphone moisture barrier and cover plate have been omitted from the drawing.

A second optical fiber 16 is secured to a rigid inwardly extending portion 17 of the housing 11 such that, in the undisturbed positions of the diaphragm, the two fiber ends are offset in approximately half the thickness of the fiber.

The fibers 15 and 16 preferably have a rectangular or square cross-section and the ends are polished flat before assembly. Light from a source, e.g. a light emitting diode or a semiconductor laser, is launched into one fiber, e.g. 15, and is fed to the exchange or to another telephone instrument via the other fiber. Excitation of the diaphragm 13 by speech signals causes corresponding variations in the coupling coefficient between the two fiber ends thus directly amplitude modulating light passing across the gap between the fiber ends.

A transducer arrangement of this type may comprise a diaphragm from a standard BOP carbon transmitter which is displaced by 1 to 5 microns by normal speech signals. The optical fibers may be of the ribbon type being 25 microns by 250 microns and be attached to the diaphragm and housing respectively by an epoxy resin. The spacing between the fiber ends may be 2 microns and the off set between their major axes in the rest position of the diaphragm may be 10 microns. Light is launched into one fiber from, for example, an edge emitting gallium arsenide LED and is detected by, for example, a PIN silicon diode detector. With normal speech the modulated light signals provided a detector output in the range 5–15 m volt which after amplification produces clear speech reproduction. The linearity of transducer response and the good dynamic range results in good quality of reproduction.

The arrangement described herein is particularly suitable for use as a transmitter in a telephone subscriber's instrument of the type provided with optical coupling to the exchange or to one or more remote stations. The arrangement may also be used as a microphone in a public address system as it overcomes the difficult problem of preventing pick-up of noise when the microphone is coupled to an amplifier via a relatively long lead.

We claim:

1. A fiber optic transducer comprising:

a housing means;

flexible diaphram means supported on said housing;

a first optical fiber having a rectangular cross section, one end of said first optical fiber being secured to said diaphragm;

a second optical fiber, having a rectangular cross section being secured to said housing, said secured ends of said first and second optical fibers being positioned to provide optical coupling therebetween, such that movement of said diaphragm causes corresponding variations in the degree of coupling between said fiber ends for linearly amplitude modulating light signals passing between said fiber ends.

2. A transducer arrangement as claimed in claim 1 wherein both of said optical fibers are of the ribbon type.

3. A transducer arrangement as claimed in claim 1 wherein said first and second fibers are arranged such that, when said diaphram is in its undisturbed position, said fiber ends are separated from one another by half of the thickness of said fibers.

4. In a telephone subscriber instrument, an acousto-optical transducer arrangement comprising:

a housing means;

flexible diaphragm means supported on said housing;

a first optical fiber having a rectangular cross section, one end of said first optical fiber being secured to said diaphragm;

a second optical fiber, having a rectangular cross section being secured to said housing, said secured ends of said first and second optical fibers being positioned to provide optical coupling therebetween, such that movement of said diaphragm causes corresponding variations in the degree of coupling between said fiber ends for linearly amplitude modulating light signals passing between said fiber ends.

5. A transducer arrangement as claimed in claim 4 wherein both of said optical fibers are of the ribbon type.

6. A transducer arrangement as claimed in claim 4 wherein said first and second fibers are arranged such that, when said diaphragm is in its undisturbed position, said fiber ends are separated from one another by half of the thickness of said fibers.

* * * * *